US008298742B2

(12) United States Patent
Okamoto et al.

(10) Patent No.: US 8,298,742 B2
(45) Date of Patent: Oct. 30, 2012

(54) METHOD FOR PRODUCING ELECTROPHOTOGRAPHIC CARRIER AND ELECTROPHOTOGRAPHIC CARRIER PRODUCED BY USING THE METHOD

(75) Inventors: Naoki Okamoto, Mishima (JP); Yoshinobu Baba, Yokohama (JP); Koh Ishigami, Mishima (JP); Tomoko Endo, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 290 days.

(21) Appl. No.: 12/741,298

(22) PCT Filed: Dec. 18, 2008

(86) PCT No.: PCT/JP2008/073674
§ 371 (c)(1),
(2), (4) Date: May 4, 2010

(87) PCT Pub. No.: WO2009/081999
PCT Pub. Date: Jul. 2, 2009

(65) Prior Publication Data

US 2010/0279224 A1 Nov. 4, 2010

(30) Foreign Application Priority Data

Dec. 20, 2007 (JP) ..... 2007-328708

(51) Int. Cl.
*G03G 9/10* (2006.01)

(52) U.S. Cl. ..... 430/137.13; 430/111.2; 430/111.3; 430/111.31; 430/111.32; 430/111.33; 430/111.34; 430/111.35; 430/111.4; 430/111.41; 118/303; 118/417; 118/418

(58) Field of Classification Search .. 430/111.1–111.41, 430/137.13; 118/303, 417, 418
See application file for complete search history.

(56) References Cited

U.S. PATENT DOCUMENTS 4,478,925 A 10/1984 Miskinis
5,856,056 A * 1/1999 Omata et al. ..... 430/137.18
6,318,112 B1 * 11/2001 Lennox, III ..... 62/381
(Continued)

FOREIGN PATENT DOCUMENTS

EP 0015744 A1 9/1980
(Continued)

OTHER PUBLICATIONS

International Preliminary Report on Patentability for PCT/JP2008/073674 dated Jul. 10, 2009, 4 pages.
(Continued)

*Primary Examiner* — Christopher Rodee
*Assistant Examiner* — Rashid Alam
(74) *Attorney, Agent, or Firm* — Fitzpatrick, Cella, Harper & Scinto

(57) ABSTRACT

In a method for coating electrophotographic carrier core surfaces with a resin composition by rotating a rotator having a plurality of agitating blades on its surface in a casing; a coating treatment material that is introduced to a space defined between the rotator and the casing is in a packing of from 50% to 98% by volume; at the time of coating treatment, the electrophotographic carrier core surfaces are coat-treated with the resin composition while being put forward and put backward; and the electrophotographic carrier cores and the resin composition are, at the time of coating treatment, temperature-controlled at a specific temperature T (° C.) or below. This method enables the electrophotographic carrier core surfaces to be more uniformly coated with a coating resin.

3 Claims, 3 Drawing Sheets

U.S. PATENT DOCUMENTS

| | | | | |
|---|---|---|---|---|
| 6,495,303 | B1 * | 12/2002 | Kanda et al. | 430/137.17 |
| 7,521,163 | B2 | 4/2009 | Uemura et al. | |
| 2003/0036008 | A1 * | 2/2003 | Yamazaki et al. | 430/45 |
| 2007/0082286 | A1 * | 4/2007 | Yamashita et al. | 430/111.35 |
| 2010/0028796 | A1 | 2/2010 | Nakamura et al. | 430/110.3 |

FOREIGN PATENT DOCUMENTS

| | | | |
|---|---|---|---|
| JP | 63-235958 | | 9/1988 |
| JP | 63-235959 | | 9/1988 |
| JP | 63-235960 | | 9/1988 |
| JP | 63-298254 | | 12/1988 |
| JP | 02-208664 | | 8/1990 |
| JP | 03-055562 | | 3/1991 |
| JP | 09-160307 | | 6/1997 |
| JP | 2005-270955 | | 10/2005 |
| JP | 2006-163373 | A | 6/2006 |
| JP | 2007-163728 | | 6/2007 |
| JP | 2007-183592 | | 7/2007 |
| JP | 2007-270043 | A | 10/2007 |

OTHER PUBLICATIONS

European Search Report dated Aug. 21, 2012 in European Application No. 08863624.6.

* cited by examiner

METHOD FOR PRODUCING ELECTROPHOTOGRAPHIC CARRIER AND ELECTROPHOTOGRAPHIC CARRIER PRODUCED BY USING THE METHOD

TECHNICAL FIELD

This invention relates to a method for producing an electrophotographic carrier (a carrier for electrophotography) used in a developing method in which an electrostatic latent image formed on an electrostatic latent image bearing member is developed with a two-component developer to form a toner image on the electrostatic latent image bearing member, and an electrophotographic carrier produced by using the method.

BACKGROUND ART

In recent years, in order to meet commercial needs for accelerative shifts to color image formation in office use, for more high-definition images adaptable to the market of graphics, for higher speed adaptable to light-duty printing and for something else, two-component developers used in electrophotography are sought to achieve much higher image quality and higher stability from an aspect of performance.

In the present state of affairs, electrophotographic carriers making up such two-component developers are chiefly held by coated carriers obtained by coating ferrite particle surfaces or magnetic material dispersed resin core surfaces with a coating resin. Coat layers play roles of, e.g., making toners have stable charge quantity distribution and keeping electric charges from being injected from the electrophotographic carrier into a photosensitive member. However, studies have still not sufficiently been made on the coating of electrophotographic carrier core surfaces with the coating resin, and there still remain many problems or subjects concerning how to effect the coating uniformly.

Conventional methods for producing electrophotographic carriers include what is called a dipping method in which electrophotographic carrier cores and a coating resin solution are stirred and the latter's solvent is evaporated with stirring to coat the electrophotographic carrier core surfaces with the coating resin. A method is also available in which a coating resin solution is sprayed by means of a spray nozzle on electrophotographic carrier cores while forming them into fluidized beds, to coat the electrophotographic carrier core surfaces with the coating resin. Such wet-process coating methods have been prevalent.

The wet-process coating methods, however, have had a problem that the electrophotographic carrier particles tend to come to coalesce when the solvent evaporates. If an electrophotographic carrier the particles of which have once come to coalesce is disintegrated as a result of stirring, the electrophotographic carrier core surfaces may come bare to faces of such disintegrated particles, so that what is called a leak tends to occur which is a phenomenon that electric charges come injected from the electrophotographic carrier into the photosensitive member as mentioned above. If such a leak occurs, the surface potential of the photosensitive member may converge on development bias to make any development contrast not securable to cause blank areas in images. In addition, the fact that the electrophotographic carrier core surfaces come bare makes it unable for a toner to retain electric charges especially in a high-temperature and high-humidity environment, so that faulty images and the like tend to come about because of a low chargeability of the toner after its leaving over a long period of time.

In addition, in the wet-process coating methods, a low yield tends to result if the electrophotographic carrier particles come to coalesce. Usually, classification is carried out at the final stage of electrophotographic carrier production steps. This is because electrophotographic carrier particles having coalesced and not disintegrated come to be removed. Further, a drying step is necessary which is to remove the solvent completely, and this can be a factor of the elongation of tact time. Thus, there still remain many problems on the wet-process coating methods from an aspect of production as well.

Accordingly, a dry-process coating method is proposed as a method which can resolve the problems the above wet-process coating methods have. For example, a method is disclosed in which a powdery coating treatment material is mixed and agitated by means of a high-speed agitating mixer, during which the coating treatment is thermally carried out at glass transition point (Tg) or more of a coating resin contained in the coating treatment material, to obtain a carrier (Japanese Patent Laid-open Application No. H09-160307). However, in this method, the whole interior of an apparatus is heated with a jacket so that the whole coating treatment material can have a temperature not lower than the Tg of the coating resin contained in the coating treatment material, and hence the electrophotographic carrier particles tend to come to coalesce as stated above. Thus, this method is still unsatisfactory in that the particles should uniformly be coated.

A method is also proposed in which the dry-process coating is carried out by mechanical impact force (Japanese Patent Laid-open Application No. S63-235959). For example, a method is disclosed in which a surface treating apparatus having a rotor and a liner is used to coat the surfaces of magnetic material particles with resin particles having a particle diameter of 1/10 or less the magnetic material particles. In this method, the resin particles are dispersed on carrier particle surfaces by using an apparatus different from the apparatus for coating treatment, thus the method is disadvantageous in that it additionally requires the apparatus for dispersion. Where the apparatus for dispersion is not used, the resin particles are kept to stand liberated from carrier cores, thus it is difficult to well carry out the treatment to coat carrier core surfaces with the resin particles. In addition, even though the resin particles are made to adhere to carrier core surfaces by using an apparatus different from the apparatus for coating treatment, any excess resin particles may be left to stand liberated when the resin particles are fed in such a large quantity that they can not completely adhere to the carrier core surfaces, and hence it is difficult to carry out the coating treatment uniformly. Thus, this method gives a restriction on the coating quantity when fed, and may make it difficult to control the charge quantity of the toner or keep electric charges from being injected from the electrophotographic carrier into the photosensitive member.

As a powder treating method making use of mechanical impact force, a powder treating method is also proposed in which a strong impact force conventionally not achievable is applied making the most of an advantage a rotary blade type apparatus has (Japanese Patent Laid-open Application No. 2005-270955). According to this method, treatment can variously be carried out not only for mixing and drying particles but also for making particles composite (fusing), particle surface modification, particle surface smoothing, particle shape control (making particles spherical) and so forth. However, in order to make this method usable to carry out the treatment to coat electrophotographic carrier core surfaces with a resin composition by dry-process coating, studies have still not sufficiently been made on treatment conditions and so forth.

DISCLOSURE OF THE INVENTION

An object of the present invention is to coat electrophotographic carrier core surfaces more uniformly with a coating resin. Then, it is to obtain an electrophotographic carrier which can prevent the leak, the phenomenon of injection of electric charges from electrophotographic carrier cores into the photosensitive member, and the toner can be kept from becoming low chargeable even after it has been left in a high-temperature and high-humidity environment.

The above object is achieved by the present invention constituted as described below.

That is, the present invention is concerned with (1) a method for producing an electrophotographic carrier the carrier cores of which are coat-treated with at least a resin composition;

the production method being a method of coat-treating electrophotographic carrier core surfaces with the resin composition, using an apparatus which has a rotator having a plurality of agitating blades on its surface and a casing provided leaving a gap between its inner wall and each agitating blade, and while mixing a coating treatment material constituted of the electrophotographic carrier cores and the resin composition, by rotating the rotator, where;

the coating treatment material that is introduced to a space defined between the rotator and the casing is in a packing of from 50% by volume or more to 98% by volume or less;

at the time of coating treatment, the electrophotographic carrier cores and the resin composition are put forward in one direction in the axial direction of the rotator by means of some agitating blade(s) of the plurality of agitating blades and are put backward in opposite direction in the axial direction of the rotator by means of at least some of the other agitating blades of the plurality of agitating blades, and the electrophotographic carrier core surfaces are coat-treated with the resin composition while being put forward and put backward; and the electrophotographic carrier cores and the resin composition are, at the time of coating treatment, temperature-controlled at temperature T (° C.) within the range that satisfies the following expression (1):

$$T \leqq Tg+20 \quad (1)$$

where Tg is glass transition temperature (° C.) of a resin component contained in the resin composition.

It is concerned with (2) the method for producing an electrophotographic carrier as described in the above (1), wherein the resin composition is fed into the apparatus in the form of a powder, and, where the volume-base 50% particle diameter (D50) of the resin composition standing before it is put into coating treatment is represented by Db (μm) and the volume-base 50% particle diameter (D50) of the electrophotographic carrier cores is represented by Dc (μm), the value of Db/Dc satisfies the following expression (2):

$$0.10 \leqq Db/Dc \leqq 50 \quad (2).$$

It is concerned with (3) the method for producing an electrophotographic carrier as described in the above (1) or (2), wherein the resin composition has at least a resin component and fine particles having a number average particle diameter (D1) of from 0.01 μm or more to 3.00 μm or less.

It is concerned with (4) an electrophotographic carrier produced by the method described in any of the above (1) to (3).

It is concerned with (5) the electrophotographic carrier described in the above (4), which has a volume-base 50% particle diameter (D50) of from 15.0 μm or more to 100 μm or less and a true specific gravity of from 2.5 g/cm$^3$ or more to 5.2 g/cm$^3$ or less.

According to the present invention, the electrophotographic carrier core surfaces can be coated with the coating resin in a more closely uniform state. Also, this enables prevention of the leak, the phenomenon of injection of electric charges from electrophotographic carrier cores into the photosensitive member, and enables the toner to be kept from becoming low chargeable after it has been left in a high-temperature and high-humidity environment.

Further features of the present invention will become apparent from the following description of exemplary embodiments with reference to the attached drawings.

BEST MODE FOR CARRYING OUT THE INVENTION

Figure 1:
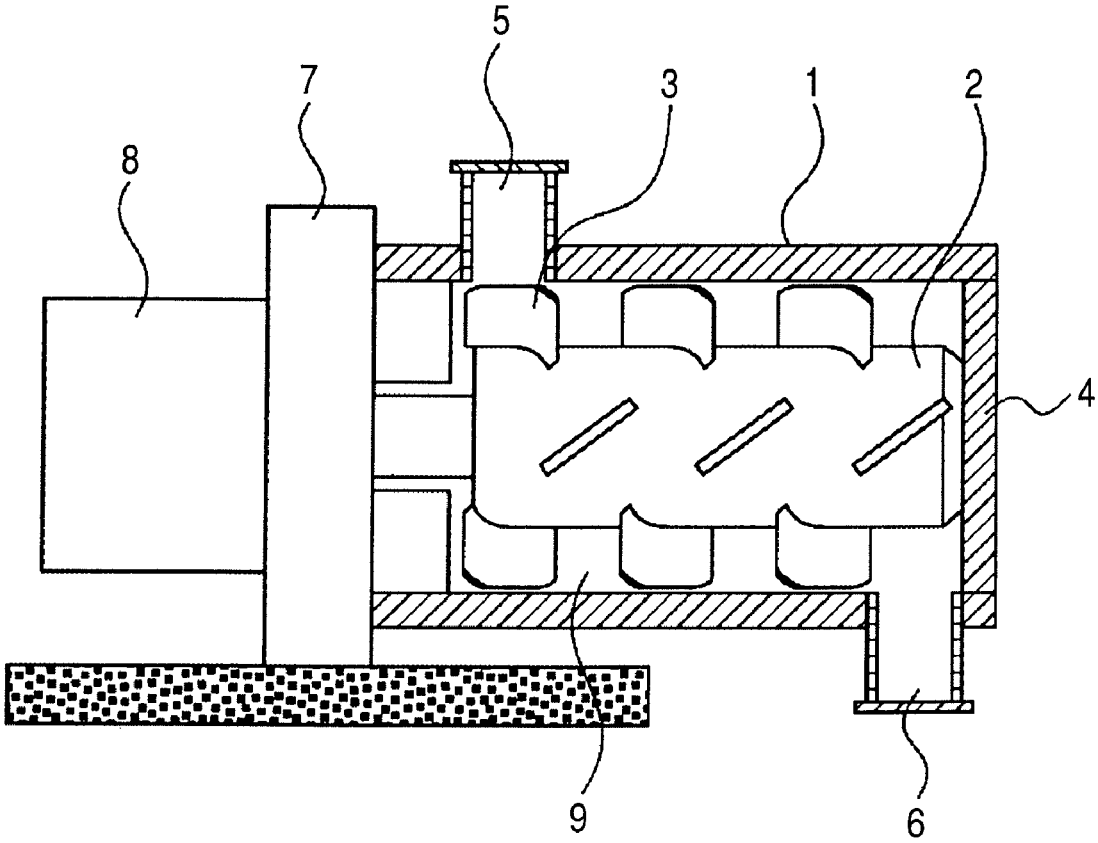
FIG. 1 is a diagrammatic view showing an example of a coating apparatus usable in the electrophotographic carrier production method of the present invention.

Modes for practicing the present invention are described below in detail.

The method for producing the electrophotographic carrier of the present invention is described first in detail.

The method for producing the electrophotographic carrier of the present invention is what is called the dry-process coating method. The present invention is described below with reference to a dry-process coating apparatus shown in FIGS. 1 and 2A.

First, a coating treatment material that has electrophotographic carrier cores and a resin composition is fed into the apparatus through a feed opening 5. The coating treatment material that is introduced to a space 9 defined between a casing 1 and a rotator 2 is in a packing of from 50% by volume or more to 98% by volume or less. This is preferable in view of an advantage that the electrophotographic carrier core surfaces can uniformly and quickly be coated with the resin composition. It may more preferably be in a packing of from 70% by volume or more to 96% by volume.

Herein, the packing refers to the proportion of the volume of the coating treatment material to the capacity of the space 9 defined between the casing 1 and the rotator 2.

Where the coating treatment material is in a packing of 50% by volume or more, the coating treatment material impacts with agitating blades 3 provided on the surface of the rotator 2 and in addition thereto the constituents of the coating treatment material come to impact with each other one after another. Hence, the carrier cores of the coating treatment material are appropriately heated on their the surfaces to come into a condition where they can readily be treated, so that the coating treatment can well efficiently and can uniformly be carried out at very small gaps between the casing 1 and the agitating blades 3. In addition, because of such a high packing of the coating treatment material, the treatment can desirably be carried out in a large quantity. If the coating treatment material is in a packing of less than 50% by volume, the constituents of the coating treatment material may impact with each other so insufficiently as to make it difficult to carry out uniform coating treatment. The condition that the coating treatment material is in a packing of 50% by volume or more is a higher packing than that in conditions commonly set for the coating treatment that utilizes mechanical impact force. Usually, the coating treatment is not carried out at such a high packing. If on the other hand the coating treatment material is in a packing of more than 98% by volume, there may be a tendency that the coating treatment material can be mixed with difficulty or a large torque is required for the driving of the apparatus.

As the way of feeding the coating treatment material into the apparatus, the electrophotographic carrier cores and the resin composition for coating may separately be fed thereinto, or these may be made into a mixture before they are fed thereinto. In the dry-process coating method of the present invention, these constituents of the coating treatment material sufficiently impact with each other, and hence it is an advantage that good coating treatment can be carried out even when they are separately fed into the apparatus.

Next, the coating treatment material is agitated and mixed by means of the agitating blades 3 provided in plurality on the surface of the rotator 2, during which it is subjected to coating treatment at the very small gaps between the casing 1 and the agitating blades 3, and thereafter the treated material is discharged out of the apparatus through a discharge opening 6. In what is shown in FIG. 1, the rotator 2 is rotated in the direction that agitating blades positioned at the lower part move upward through the front face as viewed on the drawing. Here, agitating blades 3*a* (see FIG. 2A) on the surface of the rotator 2 act as a forward agitation mechanism for putting the coating treatment material forward in the axial direction (from the feed opening 5 side to the discharge opening 6 side) of the rotator 2, and agitating blades 3*b* act as a return agitation mechanism for putting the coating treatment material backward in opposite direction in the axial direction (from the discharge opening 6 side to the feed opening 5 side) of the rotator 2.

In virtue of such mechanisms, the coating treatment material is repeatedly put forward and backward, thus the course of movement of the coating treatment material in the casing 1 can be complex and long. Being put forward and backward in this way makes the coating treatment material impact with the agitating blades 3 and also makes the constituents of the coating treatment material sufficiently impact with each other, both more sufficiently, and this enables more efficient coating treatment at the very small gaps between the casing 1 and the agitating blades. As the result, this has enabled the electrophotographic carrier core surfaces to be uniformly and quickly coated with the resin composition.

Further, at the space 9 defined between the casing 1 and the rotator 2, the coating treatment material is, during the coating treatment, temperature-controlled at temperature T (° C.) within the range that satisfies the following expression (1):

$$T \leqq Tg+20 \quad (1)$$

(where Tg is glass transition temperature (° C.) of a resin component contained in the resin composition.) Here, the temperature of the coating treatment material (i.e., material temperature) during the coating treatment refers to the temperature of atmosphere inside the casing during the coating treatment. Stated specifically, it is the maximum temperature measured when a thermocouple is attached to the inner-wall surface of the casing 1 to examine heat history at the time of the coating treatment.

In the case of the conventional thermal dry-process coating method, the material temperature at the time of coating treatment is required to be higher to a certain degree than the Tg of a resin component, and hence the whole apparatus is heated. However, the higher the material temperature is set, the more the coating treatment material may come to stay unevenly or stagnate to accelerate coalescence of the electrophotographic carrier cores. On the other hand, if the material temperature is set low, the core particles may insufficiently be coated with the resin composition. Thus, it has been very difficult to achieve both the prevention of coalescence and the uniform coating treatment.

In contrast thereto, the present invention has enabled uniform coating treatment even though the material temperature (the temperature of atmosphere inside the casing) is set lower than the Tg of the resin component. As the reason therefor, it is presumed that, in virtue of the packing (%) of the coating treatment material and the mechanism of being put forward/backward in the present invention, the coating treatment material impacts with the casing 1 and agitating blades 3 and in addition thereto the constituents of the coating treatment material effectively and frequently come to impact with each other, and this only locally makes the temperature of the coating treatment material higher than the Tg of the resin component. Then, the constituents of the coating treatment material are made to effectively and frequently come to impact with each other, and this has enabled good coating treatment and has enabled the particles to be more kept from coalescing, even though the material temperature (the temperature of atmosphere inside the casing) is set not so higher than the Tg of the resin component.

Thus, in the present invention, the controlling of material temperature T (° C.) to be not higher than Tg+20 (° C.) has enabled achievement at high levels, of both keeping the electrophotographic carrier particles from coalescing and carrying out uniform and quick coating treatment. Nevertheless, if the material temperature T (° C.) is set higher than Tg+20 (° C.), the electrophotographic carrier particles may come to tend to coalesce like those in the conventional thermal dry-process coating method. It may also come about that the resin component melt-adheres or sticks to the inner wall of the casing 1 or to the surfaces of the agitating blades 3. The material temperature T (° C.) may more preferably be within the range that is not higher than the Tg of the resin component. The lower limit value of the material temperature T (° C.) can not particularly strictly be defined, and may be about −20° C. taking account of readiness in temperature control.

In order to control the material temperature of the coating treatment material, it is preferable to use a rotator or casing having a jacket 4 through which a heat control medium can be flowed. A fluid such as cooling water, hot water, steam or oil may be used as the heat control medium.

As the positional relationship of the agitating blades 3 provided on the surface of the rotator 2, they may preferably be disposed in the following way. For example, it is preferable that each agitating blade 3*a* overlaps at its edge position on the feed opening 5 side, with its adjacent other agitating blade 3*b* on the feed opening 5 side at the latter's edge position on the discharge opening 6 side, and at a position in the axial direction. That is, the agitating blades may preferably have a positional relationship that, where, in FIG. 2A, lines are drawn in the vertical direction from the edge position of the agitating blade 3*a*, the agitating blade 3*a* and the agitating blade 3*b* which are adjacent to each other overlap by width d. The same positional relationship applies also in respect of the other agitating blades. Inasmuch as the agitating blade 3*a* and the agitating blade 3*b* have this positional relationship, the coating treatment material can readily move from the edge of the agitating blade 3*a* to the edge of the agitating blade 3*b*, thus the coating treatment material can more effectively be put forward and backward as the rotator 2 is rotated.

Figure 2A:
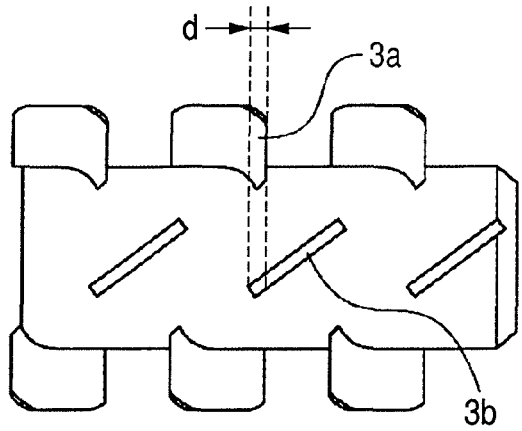
FIGS. 2A, 2B, 2C and 2D are diagrammatic views showing how agitating blades are set up which are used in the coating apparatus usable in the electrophotographic carrier production method of the present invention.
Figure 2B:
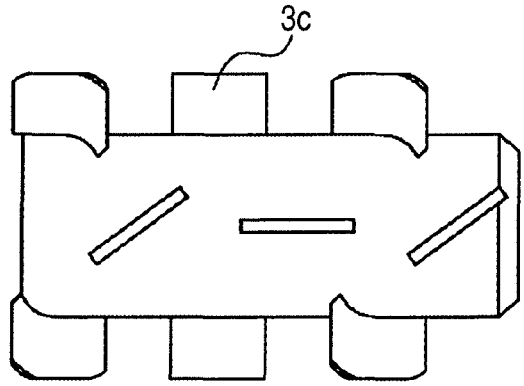
Figure 2C:
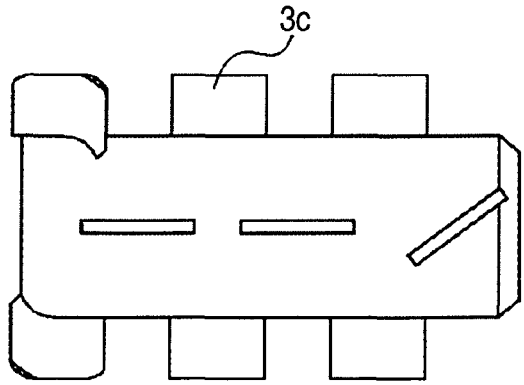
Figure 2D:
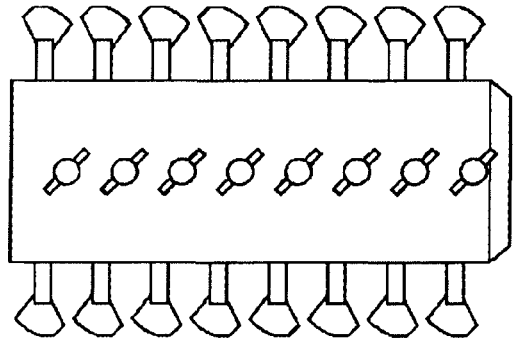

As the shapes of the agitating blades 3 used in the electrophotographic carrier production method of the present invention, those as shown in FIGS. 2A, 2B, 2C and 2D may be employed. Besides the forward and backward agitating blades like the agitating blades 3*a* and 3*b* as shown in FIG. 2A, agitating blades 3*c* as shown in FIGS. 2B and 2C may also be provided which are disposed in the same direction as the axial direction of the rotator. The agitating blades 3 may also have, as their shape, the shape of paddles as shown in FIG. 2D. In regard to angles of the agitating blades, they may appropriately be adjusted in accordance with particle diameter, true specific gravity and fluidity of the coating treatment material.

In the production of the electrophotographic carrier, the resin composition may preferably be fed into the apparatus in the form of a powder. In the case of the conventional dry-process coating method, it has been common that, where the volume-base 50% particle diameter (D50) of the resin composition standing before it is put into coating treatment is represented by Db (μm) and the volume-base 50% particle diameter (D50) of the electrophotographic carrier cores is represented by Dc (μm), the value of Db/Dc is less than 0.10. This is because, unless the particle diameter of the resin composition is made vastly smaller than that of the electrophotographic carrier cores so as to be improved in adhesion between the electrophotographic carrier cores and the resin composition, any good coating treatment can not be carried out when the mechanical impact force is used, and a resin composition standing liberated from the cores may inevitably remain in a large quantity. Also when thermal coating treatment is carried out, a resin composition having relatively large particle diameter may come to stay unevenly or stagnate to accelerate coalescence of the electrophotographic carrier cores around such particles serving as base points. That is, in the conventional method, there has been a limit on the size of particles which can adhere to the electrophotographic carrier core surfaces.

However, when the apparatus according to the present invention is used, good coating treatment can be carried out even where the value of Db/Dc satisfies the following expression (2):

$$0.10 \leqq Db/Dc \leqq 50 \quad (2).$$

If a limitation factor is imposed on the particle size of the resin composition as in the conventional dry-process coating method, a disadvantage may come about in producing resin particles. For example, when Dc is 40 μm, Db must be 4.0 μm or less. As a method by which a resin composition of 4.0 μm or less in particle size is prepared, a method is available in which the resin particles are prepared by polymerization, or by pulverization, to obtain the resin particles of 4.0 μm or less in particle size. In the case when the resin particles are prepared by polymerization, emulsion polymerization or suspension polymerization is available, either of which, however, requires compositional limitation on resins. In the case when the resin particles are prepared by pulverization, the energy for making particles finer is more necessary as the Db is made smaller, to give causes of an increase in cost and an increase in $CO_2$ emissions.

In contrast thereto, in the present invention, the coating treatment material can be in a high packing and enjoy the mechanism of being put forward and backward, to make the constituents of the coating treatment material effectively impact with each other. Hence, this makes it low necessary to make the resin composition previously adhere to the cores, and also allows a wide selectivity about the resin composition.

As described above, the value of Db/Dc may be 0.10 or more. If, however, the value of Db/Dc is more than 50, the electrophotographic carrier core particles may come to tend to be taken into resin composition particles, resulting in a decrease in efficiency of the coating treatment. In the present invention, the value of Db/Dc may more preferably be within the range of from 0.10 or more to 10 or less.

According to the production method of the present invention, it has also enabled the electrophotographic carrier core particles to be coated with the resin composition in a larger coating quantity in making the latter adhere to the former. As the coating quantity (i.e., feed coating quantity), the resin composition may preferably be in an amount of from 0.1 to 20 parts by mass based on 100 parts by mass of the electrophotographic carrier cores. If the resin composition is in an amount of more than 20 parts by mass, the resin composition tends to remain in a large quantity as it stands liberated from the cores. Its coating quantity may preferably be within the range of from 0.3 to 15 parts by mass, and still more preferably within the range of from 0.5 to 10 parts by mass. In view of the fact that the coating treatment can be carried out in the coating quantity within this range, the production method of the present invention can be said to be a production method that can broaden the extent of material designing for controlling the charge quantity of the toner and keeping electric charges from being injected from the electrophotographic carrier into the photosensitive member.

It is also preferable that, where the true specific gravity of the electrophotographic carrier cores is represented by A ($g/cm^3$) and the true specific gravity of the resin composition for coating is represented by B ($g/cm^3$), the value of B/A satisfies the following expression (3):

$$0.20 \leqq B/A \leqq 0.80 \quad (3);$$

provided that $2.5 \leqq A \leqq 5.2$ and $1.0 \leqq B \leqq 2.0$.

As long as the above ratio of true specific gravity (B/A) is 0.80 or less, the coating treatment can be free of any excess load that may be applied because of interparticle impact between base particles and coating particles during the treatment, so that the electrophotographic carrier cores can be kept from coming to break or chip. On the other hand, as long as the ratio B/A is 0.20 or more, the influence of difference in specific gravity between the base particles and the coating particles can be so small that the coating treatment material can well be agitated and mixed.

Production conditions concerning the above dry-process coating method are described next with reference to FIG. 1.

As preferable peripheral speed of the agitating blades 3, it may be from 5 m/sec or more to 50 m/sec or less at outermost edges of the blades. This is preferable in view of the advantage that the electrophotographic carrier core surfaces can uniformly and quickly be coated with the resin composition. It may more preferably be from 10 m/sec or more to 20 m/sec or less.

As long as the peripheral speed of the agitating blades 3 is within the above range, any resin composition may less remain not participated in the coating treatment and also the carrier cores can be kept from coming to break or chip, thus good coating treatment can more stably be carried out.

As for the gap between the casing 1 and each agitating blade 3, it may be from 0.5 mm or more to 30.0 mm or less. This is preferable in view of the advantage that the electrophotographic carrier core surfaces can uniformly and quickly be coated with the resin composition. It may more preferably be from 1.0 mm or more to 10 mm or less.

As long as the gap between the casing 1 and each agitating blade 3 is within the above range, good coating treatment can stably be carried out like the case when the peripheral speed of the agitating blades is within the above range.

The electrophotographic carrier obtained by the production process of the present invention may also preferably have a volume-base 50% particle diameter (D50) of from 15.0 μm or more to 100.0 μm or less and a true specific gravity of from 2.5 g/cm$^3$ or more to 5.2 g/cm$^3$ or less. Inasmuch as the electrophotographic carrier of the present invention has a D50 of from 15.0 μm or more to 100 μm or less, the density of a magnetic brush at development poles can be optimized and also the toner can have a sharp charge quantity distribution, and hence a high image quality can be achieved. It may more preferably have a D50 of from 20.0 μm or more to 80.0 μm or less.

Inasmuch as it also has a true specific gravity of from 2.5 g/cm$^3$ or more to 5.2 g/cm$^3$ or less, the difference in specific gravity between the toner and the carrier can be within a preferable range, and the carrier can have a better charge-providing performance to the toner. It may more preferably have a true specific gravity of from 2.5 g/cm$^3$ or more to 4.2 g/cm$^3$ or less. That is, the toner and the electrophotographic carrier can be agitated in a developer container in an optimum condition, and hence the toner can quickly electrostatically be charged. In addition, the carrier can keep the toner from deteriorating and further, where it is used as a carrier for a replenishing developer, good images can be obtained over a long period of time also where the developer is replenished with the replenishing developer.

The electrophotographic carrier of the present invention may also preferably have a specific resistance of from $1.0\times10^6\Omega\cdot$cm or more to $1.0\times10^{15}\Omega\cdot$cm or less at an electric-field intensity of 5,000 V/cm. It may more preferably have a specific resistance of from $1.0\times10^7\Omega\cdot$cm or more to $1.0\times10^{12}\Omega\cdot$cm or less. If it has a specific resistance of less than $1.0\times10^6\Omega\cdot$cm, the leak may very likely occur. If it has a specific resistance of more than $1.0\times10^{15}\Omega\cdot$cm, the developer may have a low developing performance at a low electric-field intensity. Inasmuch as the production process of the present invention is employed, in virtue of the advantages that the carrier cores can uniformly be coated and can not easily come to coalesce, the use of the electrophotographic carrier having the specific resistance within the above range enables achievement of a satisfactory developing performance and a high image density.

As the electrophotographic carrier cores, known magnetic carrier cores may be used, such as ferrite particles, magnetite particles and magnetic material dispersed resin carrier cores.

The electrophotographic carrier cores are produced, e.g., in the following way.

The electrophotographic carrier cores are produced using a magnetic material. The magnetic material may include magnetic ferrite particles containing at lease one element selected from iron, lithium, beryllium, magnesium, calcium, rubidium, strontium, nickel, copper, zinc, cobalt, manganese, chromium and titanium, or magnetite particles. It may preferably include magnetite particles, or magnetic ferrite particles containing at lease one element selected from copper, zinc, manganese, calcium, lithium and magnesium.

As a ferrite magnetic material, it may include the following: Ferrite magnetic materials of iron type oxides, such as Ca—Mg—Fe type ferrite, Li—Fe type ferrite, Mn—Mg—Fe type ferrite, Ca—Be—Fe type ferrite, Mn—Mg—Sr—Fe type ferrite, Li—Mg—Fe type ferrite and Li—Rb—Fe type ferrite.

The ferrites of iron type oxides may be obtained by mixing any of oxides of the respective metals, a carbonate and a nitrate by a wet process or a dry process, and calcinating the resultant mixture so as to have the desired ferrite composition. Next, the iron type oxide ferrites thus obtained may each be pulverized up to those of submicrons in size. To the ferrite thus pulverized, water for controlling particle diameter may be added in an amount of 20 to 50% by mass, followed by addition of, e.g., polyvinyl alcohol (molecular weight: 500 to 10,000) as a binder resin in an amount of 0.1 to 10% by mass to prepare a slurry. This slurry may be granulated by means of a spray dryer, followed by firing to obtain ferrite cores.

Porous ferrite cores may also be obtained by adding, at the time of granulation, sodium carbonate or calcium carbonate for controlling porosity and also a pore adjuster such as an organic matter of various types to form a slurry, followed by granulation by means of a spray dryer, and further followed by firing. A material that may inhibit the growth of particles during ferrite-forming reaction may also be added to form complicated pores in the interior of the ferrite. Such a material may include tantalum oxide and zirconium oxide.

To produce the magnetic material dispersed resin carrier cores, for example a vinyl type or non-vinyl type thermoplastic resin, the magnetic material and other additives may well be mixed by means of a mixing machine. The mixture obtained may be melt-kneaded by using a kneading machine such as a heat roll, a kneader or an extruder. The melt-kneaded product obtained may be cooled and then pulverized, and the pulverized product may further be classified to obtain the magnetic material dispersed resin carrier cores. The magnetic material dispersed resin carrier cores thus obtained may further be made spherical by a thermal or mechanical means.

As still another method, a monomer(s) for forming a binder resin of the magnetic material dispersed resin carrier cores may be polymerized in the presence of the magnetic material to obtain the carrier cores. Here, the monomer(s) for forming the binder resin may include the following: Vinyl monomers; phenols and epichlorohydrin, for forming epoxy resins; phenols and aldehydes, for forming phenolic resins; ureas and aldehydes, for forming urea resins; and melamine and aldehydes.

Particularly preferred is a method of synthesizing phenolic resins from phenols and aldehydes. In this case, a phenol and an aldehyde which are held in an aqueous medium may be polymerized in the presence of a basic catalyst to produce the magnetic material dispersed resin carrier cores.

The phenols for forming the phenolic resins may be, besides phenol itself (hydroxybenzene), compounds having a phenolic hydroxyl group. The compounds having a phenolic hydroxyl group may include alkylphenols such as m-cresol, p-tert-butylphenol, o-propylphenol, resorcinol and bisphenol A; and halogenated phenols part or the whole of the aromatic ring (e.g., benzene ring) or alkyl group of which has been substituted with a chlorine atom(s) or a bromine atom(s).

The aldehydes for forming phenolic resins may include the following: They are, e.g., formaldehyde in the form of either of formalin and paraldehyde, and furfural. Formaldehyde is Preferred.

The molar ratio of the aldehyde to the phenol may preferably be from 1:1 to 1:4, and more preferably from 1:1.2 to 1:3. If the molar ratio of the aldehyde to the phenol is less than 1, the particles may be formed with difficulty, or, even if formed, the curing of the resin may proceed with difficulty, and hence the particles formed tend to have a low strength. If on the other hand the molar ratio of the aldehyde to the phenol is more than 4, unreacted aldehydes remaining in the aqueous medium after the reaction tend to be in a large quantity.

Condensation polymerization of the phenol and the aldehyde may be carried out using a basic catalyst. The basic catalyst may be any of catalysts used in producing usual resol type resins. Such a basic catalyst may include, e.g., ammonia water, hexamethyltetramine and dimethylamine, as well as alkylamines such as dimethylamine, diethyltriamine and polyethyleneimine. The molar ratio of any of these basic catalysts to the phenol may preferably be from 1:0.02 to 1:0.30.

The resin composition with which the electrophotographic carrier core surfaces are to be coated is described next.

The resin composition used in the present invention has at least a resin component. As the resin component for coating, a thermoplastic resin may preferably be used. As the resin component, it may be one kind of resin, or a combination of two or more kinds of resin.

The thermoplastic resin as the resin component for coating may include, e.g., polystyrene; acrylic resins such as polymethyl methacrylate and a styrene-acrylic acid copolymer; a styrene-butadiene copolymer; an ethylene-vinyl acetate copolymer; polyvinyl chloride, polyvinyl acetate; polyvinylidene fluoride resins; fluorocarbon resins; perfluorocarbon resins; solvent-soluble perfluorocarbon resins; polyvinyl alcohol; polyvinyl acetal; polyvinyl pyrrolidone; petroleum resins; cellulose; cellulose derivatives such as cellulose acetate, cellulose nitrate, methyl cellulose, hydroxymethyl cellulose, hydroxyethyl cellulose and hydroxypropyl cellulose; novolak resins; low-molecular-weight polyethylene; saturated alkyl polyester resins; polyester resins such as polyethylene terephthalate, polybutylene terephthalate and polyacrylate; polyamide resins; polyacetal resins; polycarbonate resins; polyether sulfone resins; polysulfone resins; polyphenylene sulfide resins; and polyether ketone resins.

The resin component contained in the resin composition may contain THF(tetrahydrofuran)-soluble matter having a weight average molecular weight Mw of from 15,000 to 300,000. This is preferable in view of its adhesion to the electrophotographic carrier cores and an advantage that, when coated therewith, the electrophotographic carrier core surfaces can especially uniformly be coated.

The resin composition used in the coating treatment of the electrophotographic carrier core particles may also preferably have at least the resin component and fine particles having a number average particle diameter (D1) of from 0.01 μm or more to 3.00 μm or less. This is because, when the electrophotographic carrier core surfaces are coated with the resin composition having the resin component, the fine particles come present between the electrophotographic carrier core particles themselves to exercise a spacer effect and this enables the electrophotographic carrier core particles to be well kept from coming to coalesce, to bring a further improvement in coating uniformity. If the fine particles have a number average particle diameter of less than 0.01 μm, the spacer effect is not sufficiently obtained and the effect of improving the coating uniformity can not sufficiently be obtained. If on the other hand the fine particles have a number average particle diameter of more than 3.00 μm, though the spacer effect is obtained, the fine particles may come dispersed non-uniformly and hence the toner may come to be unevenly electrostatically charged.

The fine particles may preferably be contained in the resin composition in a proportion of from 2 to 100 parts by mass based on 100 parts by mass of the resin component. As long as the fine particles are contained within the above range, the spacer effect that is the effect brought by the addition of the fine particles can sufficiently be brought out. In addition, after the resin composition and the core particles impact with and rub against each other and the core particle surfaces have partly been coated with the resin composition, the excess resin composition and the coated core particles can be made well separable from each other. On account of these effects, the coating with resin can more favorably be carried out. Meanwhile, the durability of coat layers is by no means damaged.

The fine particles to be contained in the resin composition may be fine particles of either of an organic material and an inorganic material. Preferred are fine cross-linked resin particles, or inorganic fine particles, having strength high enough to retain the shape of fine particles when coated. As a cross-linked resin that forms the fine cross-linked resin particles, it may include cross-linked polymethyl methacrylate resin, cross-linked polystyrene resin, melamine resin, guanamine resin, urea resins, phenolic resins and nylon resins. The inorganic fine particles may include fine particles of magnetite, hematite, silica, alumina and titania. In particular, such inorganic fine particles are preferred in view of promotion of charge-providing performance to the toner, making charge-up less occur, and improvement in releasability from the toner. As the shape of the fine particles, spherical fine particles may preferably be used in order to obtain the spacer effect in carrying gout the coating treatment.

The fine particles contained in the resin composition form unevenness on the surfaces of the electrophotographic carrier cores having been coated with the resin composition, and hence they also so act as to improve the charge-providing performance to the toner. From this viewpoint, the fine particles may preferably have a volume resistivity of $1\times10^{6}\Omega\cdot$cm or more.

The resin composition for coating may also further contain conductive fine particles. The conductive fine particles may preferably have a volume resistivity of $1\times10^{8}\Omega\cdot$cm or less, and more preferably from $1\times10^{-6}\Omega\cdot$cm or more to less than $1\times10^{6}\Omega\cdot$cm.

The conductive fine particles may include fine carbon black particles, fine graphite particles, fine zinc oxide particles and fine tin oxide particles. In particular, fine carbon black particles are preferred as the conductive fine particles. These conductive fine particles can contribute to appropriate control of the specific resistance of the electrophotographic carrier by their addition in a small quantity, because of their good conductivity.

As examples of a process for producing the resin component to be contained in the resin composition for coating, any polymerization process may be employed, such as solution polymerization, emulsion polymerization and suspension polymerization. The resin composition may preferably be fed into the apparatus in the state of fine particles that, as described previously, the value of Db/Dc satisfies 0.10 or more to 50 or less where the D50 of the resin composition is represented by Db (μm) and the D50 of the electrophotographic carrier cores by Dc (μm). The resin composition having particle diameter within this range may be obtained by changing conditions appropriately at the time of polymerization reaction or, after the polymerization reaction, drying the resin obtained and pulverizing the resin dried.

Where the fine particles are added to the resin composition, they may be added at the time of the polymerization reaction, or may be mixed therewith by means of a mixer after the pulverization. Instead, a resin solution prepared by dissolving the resin component in a solvent may be dried up by spray drying, and the product obtained may be used as the resin composition. Where the fine particles are added when the resin composition is obtained by such spray drying, the fine particles may be dispersed in the resin solution by means of a bead mill making use of media and thereafter the dispersion obtained may be dried up by spray drying or may be mixed by means of a mixer after it has been dried up. Further, where the resin component used in the resin composition is a solid material having a large particle diameter, the resin component and the fine particles may be mixed and the mixture of the resin component and fine particles may be kneaded by means of a twin-screw extruder, followed by pulverization by means of a pulverizer to obtain the resin composition. Such a method may also preferably be used.

As the toner used together with the electrophotographic carrier of the present invention, any known toner may be used, which may be one obtained by any processes such as pulverization, polymerization, emulsion agglomeration or dissolution suspension. As a chief component of a binder resin therefor, it is preferable to use a polyester resin, a vinyl resin or a hybrid resin.

Measuring methods concerning the present invention are described below in detail.

How to Calculate Packing

First, the apparent density after tapping (g/cm$^3$) of the coating treatment material (a mixture of the electrophotographic carrier cores and the resin composition) is measured with Powder Tester PT-R (manufactured by Hosokawa Micron Corporation). It is measured in an environment of 23° C./50% RH. First, using a sieve of 150 μm in mesh opening, the coating treatment material is supplied into a metallic cup of 100 ml in capacity while vibrating it at an oscillation of 1 mm. Then, vibrating the metallic cup at an oscillation of 18 mm, tapping is up and down reciprocally carried out 180 times while supplying the coating treatment material in accordance with the level having decreased as a result of the tapping. After the tapping, the coating treatment material in the metallic cup is leveled, and apparent density after tapping P (g/cm$^3$) is calculated from the mass of the coating treatment material having remained therein.

Next, the coating treatment space (the space defined between the casing and the rotator) of the apparatus is filled with water, and its space volume is measured.

The state of being packed with the coating treatment material corresponding to the mass found when the apparent density after tapping of the coating treatment material is multiplied by the space volume of the space defined between the casing and the rotator is assumed as packing of 100%, and the mass of the mixture is adjusted in accordance with the packing of the material fed into the apparatus.

Measurement of Glass Transition Point (Tg) of Resin Component Contained in Resin Composition for Coating The glass transition point (Tg) of the resin component contained in the resin composition is measured according to ASTM D3418-82, using a differential scanning calorimetry analyzer "Q1000" (manufactured by TA Instruments Japan Ltd.).

The temperature at the detecting portion of the instrument is corrected on the basis of melting points of indium and zinc, and the amount of heat is corrected on the basis of heat of fusion of indium.

Stated specifically, the resin composition is precisely weighed in an amount of about 10 mg, and then put into a pan made of aluminum and an empty pan made of aluminum is used as reference. Measurement is made at a heating rate of 10° C./min within the measurement range of from 30° C. to 200° C. In the course of this heating, changes in specific heat are found within the range of temperature of from 40° C. to 100° C. The point at which the middle-point line between the base lines of a differential thermal curve before and after the appearance of the changes in specific heat thus found and the differential thermal curve intersect is regarded as the glass transition point (Tg) of the resin component contained in the resin composition.

Measurement of Number Average Particle Diameter (D1) of Fine Particles Contained in Resin Composition for Coating The particle size distribution of the fine particles is measured in the state the resin component contained in the resin composition has been dissolved in an organic solvent in which the former is soluble and the fine particles have been dissolved in the solvent. A laser diffraction particle size distribution meter LS-230 (manufactured by Beckman Coulter, Inc.), to which a small-level module is attached, is used as a measuring instrument to make measurement. An optical model used in making the measurement is set to be 1.5 in real part and 0.3 in imaginary part and, as the refractive index of a solvent, the refractive index of the organic solvent used is inputted thereto.

Measurement of Volume-Base 50% Particle Diameter (D50) of Resin Composition for Coating, Electrophotographic Carrier Cores and Electrophotographic Carrier Each The particle size distribution is measured with a microtrack particle size analyzer MT3300EX (manufactured by Nikkiso Co. Ltd.). In the measurement, Turbotrac sample feeder for dry-process measurement is attached.

Measurement of true specific gravity of electrophotographic carrier cores, resin composition for coating and electrophotographic carrier each As preparation for samples, the electrophotographic carrier is usable as it is, but it is necessary for the electrophotographic carrier cores and the resin composition to be separated from the electrophotographic carrier. These are separated in the following way. First, 100 parts by mass of the electrophotographic carrier is weighed out into a lidded glass bottle, and then 200 parts by mass of toluene is added thereto, followed by shaking by means of a shaker (Model-YS-8D, manufactured by K.K. Yayoi). As oscillation conditions, the shaker is worked at 200 rpm for 2 minutes. After the shaking, the toluene solution is separated while the electrophotographic carrier cores are collectively attracted with a magnet from the outside of the bottle. This is repeated five times, followed by drying at 50° C. for 8 hours by means of a vacuum dryer and then cooling to normal temperature to obtain the electrophotographic carrier cores. Meanwhile, the toluene is removed from the toluene solution to obtain the resin composition. These are used as measuring samples.

As a method for measuring the true specific gravity, a measuring method is used which is of a type of gas displacement by helium. ACCUPYC 1330 (manufactured by Shimadzu Corporation) is used as a measuring instrument. As measuring conditions, 4 g of each sample is put into a cell made of stainless steel which is of 18.5 mm in inner diameter, 39.5 mm in length and 10 cm$^3$ in capacity. Then, the volume of the sample held in the sample cell is measured by changes in pressure of helium, and the true specific gravity is determined from the volume found and the mass of the sample.

Measurement of Molecular Weight of Resin Component Contained in Resin Composition for Coating Molecular weight distribution of THF-soluble matter of the resin component contained in the resin composition may be measured by gel permeation chromatography (GPC) in the following way.

First, the resin composition is dissolved in tetrahydrofuran (THF) at room temperature over a period of 24 hours. Then, the solution obtained is filtered with a solvent-resistant membrane filter "MAISHORIDISK" (available from Tosoh Corporation) of 0.2 μm in pore diameter to make up a sample solution. Here, the sample solution is so adjusted that the component soluble in THF is in a concentration of about 0.8% by mass. Using this sample solution, the measurement is made under the following conditions.

Apparatus: HLC8120 GPC (detector: RI) (manufactured by Tosoh Corporation).

Columns: Combination of seven columns, Shodex KF-801, KF-802, KF-803, KF-804, KF-805, KF-806 and KF-807 (available from Showa Denko K.K.).

Eluent: Tetrahydrofuran (THF).

Flow rate: 1.0 ml/min.

Oven temperature: 40.0° C.

Amount of sample injected: 0.10 ml.

To calculate the molecular weight of the sample, a molecular weight calibration curve is used which is prepared using a standard polystyrene resin (e.g., TSK Standard Polystyrene F-850, F-450, F-288, F-128, F-80, F-40, F-20, F-10, F-4, F-2, F-1, A-5000, A-2500, A-1000, A-500; available from Tosoh Corporation).

Figure 3:
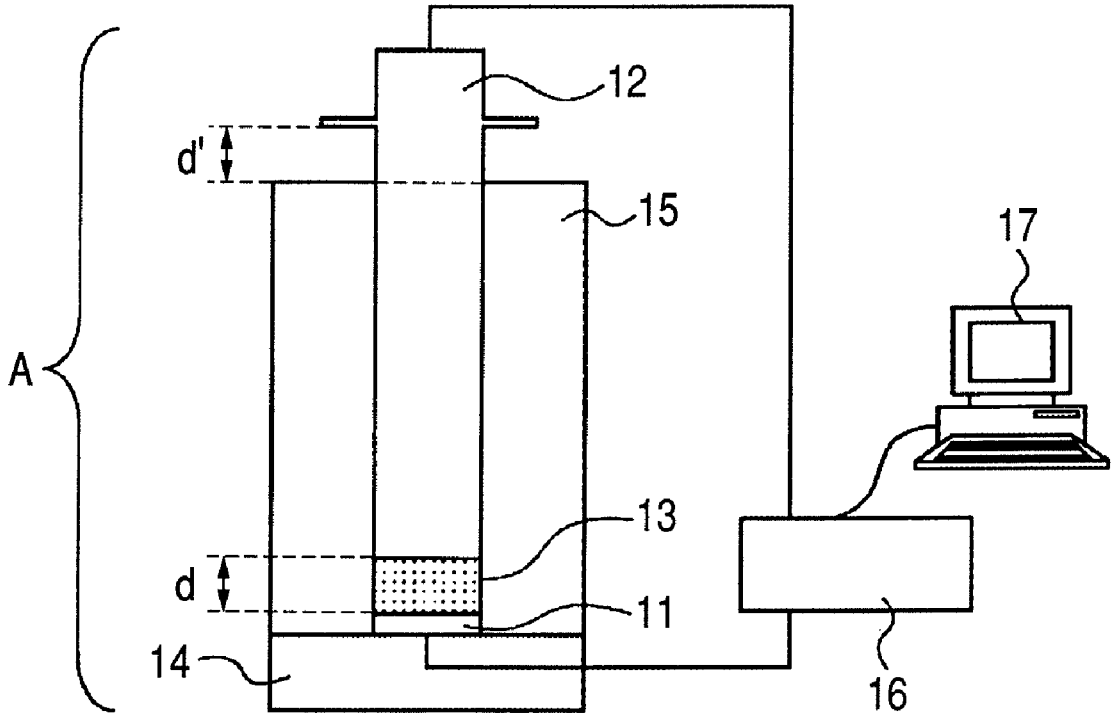
FIG. 3 is a diagrammatic view showing an example of a measuring instrument which measures specific resistance of the electrophotographic carrier of the present invention.

Measurement of Specific Resistance of Electrophotographic Carrier and Carrier Cores The specific resistance of the electrophotographic carrier is measured with a measuring instrument schematically shown in FIG. 3. A resistance measuring cell A is made up of a cylindrical PTFE resin container 15 having been holed to be 2.4 $cm^2$ in sectional area, a lower electrode (made of stainless steel) 11, a supporting stand (made of PTFE resin) 14 and an upper electrode (made of stainless steel) 12. The cylindrical PTFE resin container 15 is placed on the supporting stand 14, and about 0.7 g of a sample (e.g., the carrier) 13 is loaded therein, where the upper electrode 12 is placed on the sample 1 loaded and the thickness of the sample is measured. The thickness found when the sample is previously not present is represented by d' (blank), the sample thickness found when about 0.7 g of the sample has been loaded is represented by d, and the thickness found when the sample has been loaded is represented by d' (sample), the thickness of the sample may be represented by the following expression:

$$d = d'(\text{sample}) - d'(\text{blank}).$$

Voltage may be applied across the electrodes and the electric current flowing there may be measured to determine the specific resistance of the carrier and carrier cores each. In the measurement, an electrometer 26 (KEITHLEY 6517, manufactured by Keithley Instruments Inc.) is used, and a computer 17 is used for control.

As measuring conditions, the area of contact S between the magnetic component and the electrode is set to be 2.4 $cm^2$, and the load of the upper electrode, 240 g.

As conditions for the application of voltage, using an inner program of the electrometer, first the electrometer itself judges whether or not 1,000 V in maximum is applicable (the range that does not exceed a limiter of electric current) to decide the maximum value of applied voltage automatically. Voltage values found by dividing the maximum voltage value into five are retained for 30 seconds as steps, and electric current values found after that are measured. For example, where the maximum voltage value is 1,000 V, voltages of 1,000 V, 800 V, 600 V, 400 V and 200 V are applied, which are retained for 30 seconds at the respective steps, and electric current values found after that are measured. The values found are processed on the computer to calculate electric-field intensity and specific resistance, which are then plotted on a graph. The specific resistance and the electric-field intensity are found according to the following expression:

$$\text{Specific resistance } (\Omega\cdot\text{cm}) = [\text{applied voltage (V)}/\text{measured current (A)}] \times S(\text{cm}^2)/d\ (\text{cm}).$$

$$\text{Electric-field intensity(V/cm)} = \text{applied voltage(V)}/d\ (\text{cm}).$$

The specific resistance at 5,000 V/cm of the electrophotographic carrier is read from the graph as specific resistance at 5,000 V/cm of the electrophotographic carrier on the graph. The point at which a vertical line of 5,000 V/cm on the graph and a line of specific resistance measured actually intersect is put as the specific resistance at 5,000 V/cm. Where this point of intersection is not present, measurement points are extrapolated, and the point of intersection of the vertical line of 5,000 V/cm is put as the specific resistance at 5,000 V/cm.

EXAMPLES

The present invention is described below in greater detail by giving specific production examples and working examples. The present invention is by no means limited to these.

Electrophotographic Carrier Cores

Production Examples 1 to 4

Ferrite carrier cores were prepared using the following materials.

| | |
|---|---|
| $Fe_2O_3$ | 66.5% by mass |
| $MnCO_3$ | 28.1% by mass |
| $Mg(OH)_2$ | 4.8% by mass |
| $SrCO_3$ | 0.6% by mass |

A ferrite composition formulated as shown above was mixed by a wet process, and thereafter calcined at 900° C. for 2 hours. The ferrite composition calcined was pulverized by means of a ball mill. The pulverized product obtained had a number average particle diameter of 0.4 μm.

To the pulverized product obtained, water (300% by mass based on the pulverized product) and polyvinyl alcohol (3% by mass based on the pulverized product) having a weight average molecular weight of 5,000 were added, and these were put to granulation by means of a spray dryer. In an electric furnace, the granulated product obtained was fired at 1,300° C. for 6 hours in a nitrogen atmosphere of 1.0% in oxygen concentration, followed by pulverization and further followed by classification to obtain electrophotographic carrier cores (a-1) composed of Mn—Mg—Sr—Fe ferrite. Physical properties of the electrophotographic carrier cores (a-1) are shown in Table 1. Electrophotographic carrier cores (a-2) to (a-4) having different particle diameters were also obtained, changing conditions for the classification. Physical properties of the electrophotographic carrier cores (a-2) to (a-4) are shown in Table 1.

Electrophotographic Carrier Cores

Production Example 5

Ferrite carrier cores were prepared using the following materials.

| | |
|---|---|
| $Fe_2O_3$ | 66.5% by mass |
| $MnCO_3$ | 28.1% by mass |
| $Mg(OH)_2$ | 4.8% by mass |
| $SrCO_3$ | 0.6% by mass |

A ferrite composition formulated as shown above was mixed by a wet process, and thereafter calcined at 900° C. for 2 hours. The ferrite composition calcined was pulverized by means of a ball mill. The pulverized product obtained had a number average particle diameter of 0.4 μm.

To the pulverized product obtained, water (300% by mass based on the pulverized product), polyvinyl alcohol (2% by mass based on the pulverized product) having a weight average molecular weight of 5,000 and as a pore forming agent 5% by mass of sodium carbonate (number average particle diameter: 2 μm) were added, and these were put to granulation by means of a spray dryer. In an electric furnace, the granulated product obtained was fired at 1,200° C. for 4 hours in a nitrogen atmosphere of 1.0% in oxygen concentration. This was further sintered at 750° C. for 30 minutes, followed by pulverization and further followed by classification to obtain porous electrophotographic carrier cores (a-5) composed of Mn—Mg—Sr—Fe ferrite. Physical properties of the electrophotographic carrier cores (a-5) are shown in Table 1.

Electrophotographic Carrier Cores

Production Example 6

To magnetite particles (number average particle diameter: 0.3 μm), water (300% by mass based on 100% by mass of the magnetite particles) and polyvinyl alcohol (3% by mass based on 100% by mass of the magnetite particles) having a weight average molecular weight of 5,000 were added, and these were put to granulation by means of a spray dryer. In an electric furnace, the granulated product obtained was sintered at 1,300° C. for 6 hours in a nitrogen atmosphere of 1.0% in oxygen concentration, followed by pulverization and further followed by classification to obtain electrophotographic carrier cores (a-6) composed of magnetite. Physical properties of the electrophotographic carrier cores (a-6) are shown in Table 1.

Electrophotographic Carrier Cores

Production Example 7

Electrophotographic carrier cores (a-7) were produced using the following materials.

| | |
|---|---|
| Cross-linked acrylic resin | 30 parts by mass |
| Magnetite particles (number average particle diameter: 0.3 μm) | 70 parts by mass |

The above materials were mixed by means of Henschel mixer, and thereafter the mixture obtained was melt-kneaded by means of a twin-screw extruder. The kneaded product obtained was cooled, and the cooled kneaded product was crushed by means of a hammer mill to become 1 mm or less in size, followed by fine pulverization by means of a mechanical grinding machine. Next, this finely pulverized product was classified by means of an air classifier, followed by surface modification treatment by using Hybridizer (manufactured by Nara Machinery Co., Ltd.) to obtain the electrophotographic carrier cores (a-7). Physical properties of the electrophotographic carrier cores (a-7) are shown in Table 1.

Electrophotographic Carrier Cores

Production Example 8

Electrophotographic carrier cores (a-8) were produced using the following materials.

| | |
|---|---|
| Phenol | 10 parts by mass |
| Formaldehyde solution (aqueous 37% by mass solution) | 6 parts by mass |
| Magnetite particles (number average particle diameter: 0.3 μm) | 84 parts by mass |

The above materials, 5 parts by mass of a 28% by mass ammonia water and 20 parts by mass of water were put into a flask and mixed, during which the system was heated to 85° C. over a period of 30 minutes and kept thereat to carry out polymerization reaction for 3 hours to effect curing. Thereafter, the product was cooled to 30° C., and water was further added thereto. Thereafter, the supernatant liquid was removed, and the precipitated product was washed with water, followed by air drying. Then, this was dried at a temperature of 60° C. under reduced pressure (5 hPa or less) to obtain electrophotographic carrier cores (a-8) of a magnetic fine particle dispersion type in which the magnetite particles stood dispersed in the phenol resin. Physical properties of the electrophotographic carrier cores (a-8) are shown in Table 1.

TABLE 1

| Carrier cores | True specific gravity ($g/cm^3$) | Volume-base 50% particle diameter (μm) |
|---|---|---|
| a-1 | 4.8 | 40 |
| a-2 | 4.8 | 15 |
| a-3 | 4.8 | 80 |
| a-4 | 4.8 | 100 |
| a-5 | 4.8 | 40 |
| a-6 | 5.2 | 35 |
| a-7 | 2.5 | 32 |
| a-8 | 3.6 | 36 |

Resin Composition

Production Example 1

75 parts by mass of methyl methacrylate monomer and 25 parts by mass of styrene monomer were introduced into a four-necked flask having a reflux condenser, a thermometer, a nitrogen suction pipe and a stirrer of a grinding-in system. Further, 90 parts by mass of toluene, 110 parts by mass of methyl ethyl ketone and 2.0 parts by mass of azobizisovaleronitrile were added to those in the above flask. The mixture obtained was kept at 70° C. for 10 hours in a stream of nitrogen to obtain a St-MMA polymer solution. From this solution, the solvents were removed, and the solid product obtained was crushed by means of a hammer mill to obtain a resin composition (b-1) composed only of the resin component. The resin composition obtained had a weight average molecular weight Mw of 72,000 and a Tg of 90° C.

Resin Composition

Production Examples 2 to 5

100 parts by mass of methyl methacrylate monomer was introduced into a four-necked flask having a reflux condenser, a thermometer, a nitrogen suction pipe and a stirrer of a grinding-in system. Further, 90 parts by mass of toluene, 110 parts by mass of methyl ethyl ketone and 2.0 parts by mass of azobizisovaleronitrile were added thereto. The mixture obtained was kept at 70° C. for 10 hours in a stream of nitrogen to obtain an MMA polymer solution. From this solution, the solvents were removed, and the solid product obtained was crushed by means of a hammer mill to obtain resin compositions (b-2) and (b-3) having different particle diameters. Resin compositions (b-4) and (b-5) were also obtained by carrying out fine pulverization for the resin composition (b-2) by means of a mechanical grinding machine. The resin compositions (b-2) to (b-5) obtained were all composed only of the resin component. Their physical properties are shown in Table 2.

Resin Composition

Production Example 6

Resin composition (b-4): 100 parts by mass.
Carbon black (c-1) (average primary particle diameter: 20 nm; volume resistivity: $9.8\times10^{-2}\Omega\cdot$cm): 10 parts by mass.
Fine cross-linked polymethyl methacrylate resin particles (d-1) (number average particle diameter: 0.3 μm): 15 parts by mass.

The above materials were stirred and mixed for 2 minutes by means of Henschel mixer to obtain a resin composition (b-6) which was a mixture of the resin component and the fine particles. Physical properties of the resin composition (b-6) thus obtained are shown in Table 2.

Resin Composition

Production Example 7

Resin composition (b-4): 100 parts by mass.
Carbon black (c-1): 10 parts by mass.
Fine cross-linked polymethyl methacrylate resin particles (d-1): 15 parts by mass.
Toluene: 900 parts by mass.

The above materials were put to media dispersion by means of a paint shaker to obtain a resin dispersion.

Glass beads of 2 mm in diameter were used as the media, to carry out mixing for 2 hours. The resin dispersion obtained was made into fine particles by using a spray dryer (Model CL-8i, manufactured by Y. K. Ohkawara Seisakusho) to obtain a resin composition (b-7) which was a spray-dried product. Spray drying was carried out using a binary nozzle, under conditions of an air feed temperature of 90° C., a nitrogen spray pressure of 0.25 MPa, a mass treatment quantity of 0.8 kg/h and an outlet temperature of 68° C. Physical properties of the resin composition (b-7) thus obtained are shown in Table 2.

Resin Composition

Production Example 8

Resin composition (b-4): 100 parts by mass.
Carbon black (c-1): 10 parts by mass.
Fine cross-linked polymethyl methacrylate resin particles (d-1): 15 parts by mass.

The above materials were kneaded by means of a twin-screw extruder (PCM-30, manufactured by Ikegai Corp.) at a kneading temperature of 160° C., and the kneaded product obtained was crushed by means of a hammer mill. Thereafter, the crushed product obtained was finely pulverized by using a mechanical grinding machine (TURBO MILL Model 250, manufactured by Turbo Kogyo Co., Ltd.) at a number of revolutions of 8,000 rpm to obtain a resin composition (b-8) which was a kneaded and pulverized product. Physical properties of the resin composition (b-8) thus obtained are shown in Table 2.

TABLE 2

| | Formulation | | | | | | | | |
|---|---|---|---|---|---|---|---|---|---|
| | Resin component | | | Conductive agent | | Fine particles | | True specific gravity of resin composition ($g/cm^3$) | Volume-base 50% particle diameter of resin composition (μm) |
| Resin composition | Type | Mw | Tg (° C.) | Type | Amount based on 100 parts of resin composition (parts) | Type | Amount based on 100 parts of resin composition (parts) | | |
| b-1 | St-MMA | 72,000 | 90 | — | — | — | — | 1.1 | 351 |
| b-2 | MMA | 80,000 | 100 | — | — | — | — | 1.2 | 444 |
| b-3 | MMA | 80,000 | 100 | — | — | — | — | 1.2 | 2,080 |
| b-4 | MMA | 80,000 | 100 | — | — | — | — | 1.2 | 30 |
| b-5 | MMA | 80,000 | 100 | — | — | — | — | 1.2 | 3 |
| b-6 | MMA | 80,000 | 100 | c-1 | 10 | d-1 | 15 | 1.2 | 28 |
| b-7 | MMA | 80,000 | 100 | c-1 | 10 | d-1 | 15 | 1.2 | 11 |
| b-8 | MMA | 80,000 | 100 | c-1 | 10 | d-1 | 15 | 1.2 | 7 |

Toner Production Example 30 parts by mass of polyoxypropylene(2.2)-2,2-bis(4-hydroxyphenyl)propane, 20 parts by mass of polyoxyethylene (2.2)-2,2-bis(4-hydroxyphenyl)propane, 20 parts by mass of terephthalic acid, 3 parts by mass of trimellitic anhydride, 27 parts by mass of fumaric acid and 0.1 part by mass of dibutyltin oxide were put into a 4-liter four-necked flask made of glass. Then, a thermometer, a stirring rod, a condenser and a nitrogen feed tube were attached to the four-necked flask, and this four-necked flask was placed in a mantle heater. In an atmosphere of nitrogen, the reaction was made to proceed at 210° C. for 3 hours to obtain a polyester resin. The polyester resin obtained had a peak molecular weight Mp of 6,500 and a Tg of 65° C.

Next, a toner for evaluation was produced using materials and by the method which were as shown below.

| | |
|---|---|
| Above polyester resin | 100 parts by mass |
| C.I. Pigment Blue 15:3 | 5 parts by mass |
| Paraffin wax (melting point: 75° C.) | 5 parts by mass |
| Aluminum compound of 3,5-diert-t-butylsalicylic acid | 0.5 part by mass |

The above materials were mixed using Henschel mixer (Model FM-75, manufactured by Mitsui Miike Engineering Corporation). Thereafter, the mixture obtained was melt-kneaded by means of a twin-screw extruder (Model PCM-30, manufactured by Ikegai Corp.). The kneaded product obtained was cooled, and then crushed by means of a hammer mill to a size of 1 mm or less to obtain a toner crushed product. The toner crushed product obtained was finely pulverized using a mechanical grinding machine. Thereafter, the finely pulverized product obtained was classified by means of an air classifier to obtain a toner classified product. To 100 parts by mass of the toner classified product obtained, 1.0 part by mass of anatase-type titanium oxide with a BET specific surface area of 100 $m^2/g$ and 1.0 part by mass of hydrophobic silica with a BET specific surface area of 130 $m^2/g$ were added, and these were mixed by means of Henschel mixer (Model FM-75, manufactured by Mitsui Miike Engineering Corporation) to obtain the toner for evaluation. The toner obtained had a weight average particle diameter (D4) of 6.8 μm.

Example 1

An electrophotographic carrier was produced using materials and by the method which were as shown below.

| | |
|---|---|
| Carrier cores (a-1) | 100 parts by mass |
| Resin composition (b-1) | 2 parts by mass |

The above materials were fed into the coating apparatus shown in FIG. 1, to coat the electrophotographic carrier core surfaces with the resin composition. As coating conditions, the materials were fed at a packing of 95% by volume, where the peripheral speed of the agitating blade at its outermost edge was set at 10 m/sec, the gap between the agitating blade and the casing at 3.0 mm, and the coating treatment time at 20 minutes. Here, cooling water of 15° C. in temperature was flowed through the jacket. The material temperature during the coating treatment was 76° C. The coating conditions are shown in Table 3; physical properties of the electrophotographic carrier obtained, in Table 4; and the results of evaluation of developing performance, in Table 5. The physical properties of the electrophotographic carrier and the developing performance were evaluated in the manner shown below.

—Evaluation Items—

Evaluation on the Degree of Coalescence

The electrophotographic carrier obtained was observed on an SEM (scanning electron microscope). As magnification, the carrier was observed at about 250 magnifications so that about 100 particles came in a visual field. This observation was made 10 times to make judgment according to the following criteria.

A: Particles having coalesced are less than 3% by number.

B: Particles having coalesced are 3% by number or more to less than 6% by number.

C: Particles having coalesced are 6% by number or more to less than 10% by number.

D: Particles having coalesced are 10% by number or more to less than 15% by number.

E: Particles having coalesced are 15% by number or more.

Effective Coat Level 10 g of the electrophotographic carrier obtained was weighed out into a lidded glass bottle, and then 20 g of toluene was added thereto, followed by shaking by means of a shaker (Model-YS-8D, manufactured by K.K. Yayoi). As oscillation conditions, the shaker was worked at 200 rpm for 2 minutes. After the shaking, the toluene and the resin composition were removed while the electrophotographic carrier particles were collectively attracted with a magnet from the outside of the bottle. This was repeated five times, followed by drying at 50° C. for 8 hours by means of a vacuum dryer and then cooling to normal temperature. Thereafter, the mass M2 of the remaining was measured, and the effective coat level (%) was calculated from the following expression.

$$\text{Effective coat level}(\%)=(10-M2)/(\text{proportion of resin composition fed}/10)\times 100.$$

The closer to 100% the effective coat level is, the better the coating performance is judged to be. As the reason why it does not come to 100%, it is considered that some resin composition having not completely participated in the coating treatment may unevenly be present, that the particles having coalesced may unevenly be present or that some resin composition may melt-adhere to stick to the interior of the apparatus.

Image Density 90 parts by mass of the electrophotographic carrier and 10 parts by mass of the above toner for evaluation were blended by means of a V-type mixer to prepare a two-component developer. The two-component developer obtained was evaluated on whether or not usual image density was achievable, using a full-color copying machine iRC3220N, manufactured by CANON INC. The evaluation was made in a high-temperature and high-humidity environment (H/H; 30° C., 80% RH), and development bias was so adjusted that the toner laid-on level on the photosensitive member came to 0.6 $g/cm^2$, where solid images were reproduced. On the images obtained, their densities were measured with a densitometer X-Rite, Model 500 (manufactured by X-Rite, Incorporated). An average value of 6 points was found to regard it as image density.

Q/M on Photosensitive Member (mC/kg)

At the time the toner laid-on level on the photosensitive member came to 0.6 $g/cm^2$ in evaluating the image density as above, the toner on the photosensitive member was collected by suction, using a metal cylindrical tube and a cylindrical filter. Here, the quantity Q of electric charges stored in a capacitor through the metal cylindrical tube and the mass M of the toner thus collected were measured. From the measured values found, charge quantity Q/M per unit mass (mC/kg) was calculated to find Q/M on photosensitive member (mC/kg).

Anti-Leaking

In evaluating the image density as above, the toner layer on the photosensitive member at the time the toner laid-on level on the photosensitive member came to 0.6 $g/cm^2$ and the solid images reproduced were visually evaluated to make judgment according to the following criteria. The leak is a phenomenon that electric charges move from the carrier to the photosensitive member surface. Once the leak occurs, the potential of latent images converge on development bias to make development not performable. As the result, leak marks (areas where images may come blank) come about in the toner layer on the photosensitive member. Where the leak much occurs, the leak marks may also appear in the solid images.

A: No leak mark is seen in the toner layer on the photosensitive member.

B: Leak marks are somewhat seen in the toner layer on the photosensitive member.

C: Leak marks are seen in the toner layer on the photosensitive member, but not appear in solid images.

D: Leak marks are somewhat seen to have also appeared in solid images.

E: Leak marks are seen in a large number over the whole surface of solid images.

ΔQ/M after Leaving

After the developing performance was finished being evaluated as above, a developing assembly was detached outside the copying machine and was left for 72 hours in a high-temperature and high-humidity environment (H/H; 30° C., 80% RH). Thereafter, the developing assembly was set back into the copying machine, where the charge quantity Q/M per unit mass (mC/kg) on the photosensitive member was measured. From the values of Q/M on the photosensitive member at the initial stage and that after leaving for 72 hours, judgment was made according to the following criteria.

A: The Q/M after leaving is 90% or more of the initial-stage Q/M.

B: The Q/M after leaving is 80% or more to less than 90% of the initial-stage Q/M.

C: The Q/M after leaving is 70% or more to less than 80% of the initial-stage Q/M.

D: The Q/M after leaving is 60% or more to less than 70% of the initial-stage Q/M.

E: The Q/M after leaving is 50% or more to less than 60% of the initial-stage Q/M.

Examples 2 and 3

Electrophotographic carriers were produced in the same way as in Example 1, except that in Example 1 the resin composition was changed as shown in Table 3. Each evaluation was also made in the same way. Physical properties of the electrophotographic carriers obtained are shown in Table 4, and the results of evaluation of developing performance in Table 5.

Examples 4 and 5

Electrophotographic carriers were produced in the same way as in Example 3, except that in Example 3 the packing was changed as shown in Table 3. Each evaluation was also made in the same way. Physical properties of the electrophotographic carriers obtained are shown in Table 4, and the results of evaluation of developing performance in Table 5.

Example 6

An electrophotographic carrier was produced in the same way as in Example 3, except that in Example 3 the cooling water was not flowed. Each evaluation was also made in the same way. Physical properties of the electrophotographic carrier obtained are shown in Table 4, and the results of evaluation of developing performance in Table 5.

Example 7

An electrophotographic carrier was produced in the same way as in Example 3, except that in Example 3 the cooling water was changed for hot water of 70° C. in temperature. Each evaluation was also made in the same way. Physical properties of the electrophotographic carrier obtained are shown in Table 4, and the results of evaluation of developing performance in Table 5.

Examples 8 and 9

Electrophotographic carriers were produced in the same way as in Example 3, except that in Example 3 the resin composition was changed as shown in Table 3. Each evaluation was also made in the same way. Physical properties of the electrophotographic carriers obtained are shown in Table 4, and the results of evaluation of developing performance in Table 5.

Examples 10 to 12

Electrophotographic carriers were produced in the same way as in Example 3, except that in Example 3 the electrophotographic carrier cores were changed as shown in Table 3. Each evaluation was also made in the same way. Physical properties of the electrophotographic carriers obtained are shown in Table 4, and the results of evaluation of developing performance in Table 5.

Example 13

An electrophotographic carrier was produced in the same way as in Example 3, except that in Example 30.3 part by mass of fine cross-linked polymethyl methacrylate resin particles (d-1) were fed into the apparatus together with the resin composition (b-4). Each evaluation was also made in the same way. Physical properties of the electrophotographic carrier obtained are shown in Table 4, and the results of evaluation of developing performance in Table 5.

Example 14

An electrophotographic carrier was produced in the same way as in Example 13, except that in Example 130.2 part by mass of carbon black was fed into the apparatus together with the resin composition (b-4) and fine cross-linked polymethyl methacrylate resin particles (d-1). Each evaluation was also made in the same way. Physical properties of the electrophotographic carrier obtained are shown in Table 4, and the results of evaluation of developing performance in Table 5.

Examples 15 to 17

Electrophotographic carriers were produced in the same way as in Example 3, except that in Example 3 the resin composition was changed as shown in Table 3. Each evaluation was also made in the same way. Physical properties of the electrophotographic carriers obtained are shown in Table 4, and the results of evaluation of developing performance in Table 5.

Example 18

An electrophotographic carrier was produced in the same way as in Example 15, except that in Example 15 the electrophotographic carrier cores were changed to (a-5) and the resin composition was added in an amount changed to 8 parts by mass. Each evaluation was also made in the same way. Physical properties of the electrophotographic carrier obtained are shown in Table 4, and the results of evaluation of developing performance in Table 5.

Examples 19 to 22

Electrophotographic carriers were produced in the same way as in Example 15, except that in Example 15 the electrophotographic carrier cores were changed as shown in Table 3. Each evaluation was also made in the same way. Physical properties of the electrophotographic carriers obtained are shown in Table 4, and the results of evaluation of developing performance in Table 5.

Comparative Example 1

In Example 3, the coating apparatus was changed for High-Flex Gralle, Model LFS-GS-2J (manufactured by Fukae Powtec Co., Ltd.) provided with a steam jacket, which was a high-speed agitation mixer for carrying out coating treatment thermally. As coating conditions, coating treatment was carried out at a packing of 30% by volume, a material temperature of 105° C., at a number of agitator revolutions of 620 rpm, at a number of chopper revolutions of 1,000 rpm and for a treatment time of 10 minutes. Except for these, the procedure of Example 3 was repeated to produce an electrophotographic carrier, which was then evaluated in the same way. Physical properties of the electrophotographic carrier obtained are shown in Table 4, and the results of evaluation of developing performance in Table 5.

Comparative Example 2

In Example 3, the coating apparatus was changed for a hybridization system (Model NHS-3, manufactured by Nara Machinery Co., Ltd.), which was a surface modifier for carrying out coating treatment by mechanical impact force. As coating conditions, coating treatment was carried out at a packing of 10% by volume, at a material temperature of 70° C., at a number of rotor revolutions of 2,000 rpm and for a treatment time of 3 minutes. Except for these, the procedure of Example 3 was repeated to produce an electrophotographic carrier, which was then evaluated in the same way. Physical properties of the electrophotographic carrier obtained are shown in Table 4, and the results of evaluation of developing performance in Table 5.

Comparative Example 3

In Example 3, 900 parts by mass of toluene was added to the resin composition (b-4) to prepare a resin solution and the coating apparatus was changed for a universal mixing agitator (Model 5DM, manufactured by Fuji Paudal Co., Ltd.), which was a wet-process coating apparatus. As coating conditions, coating treatment was carried out at a treatment temperature of 60° C., feeding the resin solution dividedly in five times, and for a treatment time of 3 hours. Except for these, the procedure of Example 3 was repeated to produce an electrophotographic carrier, which was then evaluated in the same way. Physical properties of the electrophotographic carrier obtained are shown in Table 4, and the results of evaluation of developing performance in Table 5.

Comparative Example 4

An electrophotographic carrier was produced in the same way as in Example 3, except that in Example 3 the packing was changed to 40% by volume. Each evaluation was also made in the same way. Physical properties of the electrophotographic carrier obtained are shown in Table 4, and the results of evaluation of developing performance in Table 5.

Comparative Example 5

An electrophotographic carrier was produced in the same way as in Example 3, except that in Example 3 the cooling water was changed for hot water of 90° C. in temperature. Each evaluation was also made in the same way. Physical properties of the electrophotographic carrier obtained are shown in Table 4, and the results of evaluation of developing performance in Table 5.

Comparative Example 6

An electrophotographic carrier was produced in the same way as in Example 3, except that in Example 3 the packing was changed to 99% by volume. Each evaluation was also made in the same way. Physical properties of the electrophotographic carrier obtained are shown in Table 4, and the results of evaluation of developing performance in Table 5.

TABLE 3

| | Carrier cores | Resin composition | Feed coating quantity (pbm) | Packing (vol. %) | Material temp. (° C.) | Db/Dc | True specific gravity ratio B/A (Resin composition/cores) |
|---|---|---|---|---|---|---|---|
| | | | Example: | | | | |
| 1 | a-1 | b-1 | 2.0 | 95 | 76 | 8.80 | 0.23 |
| 2 | a-1 | b-2 | 2.0 | 95 | 78 | 11.1 | 0.25 |
| 3 | a-1 | b-4 | 2.0 | 95 | 82 | 0.80 | 0.25 |
| 4 | a-1 | b-4 | 2.0 | 70 | 80 | 0.80 | 0.25 |
| 5 | a-1 | b-4 | 2.0 | 50 | 77 | 0.80 | 0.25 |
| 6 | a-1 | b-4 | 2.0 | 95 | 99 | 0.80 | 0.25 |
| 7 | a-1 | b-4 | 2.0 | 95 | 120 | 0.80 | 0.25 |
| 8 | a-1 | b-5 | 2.0 | 95 | 81 | 0.08 | 0.25 |
| 9 | a-1 | b-3 | 2.0 | 95 | 84 | 52.0 | 0.25 |
| 10 | a-2 | b-4 | 2.0 | 95 | 80 | 2.00 | 0.25 |
| 11 | a-3 | b-4 | 2.0 | 95 | 83 | 0.40 | 0.25 |
| 12 | a-4 | b-4 | 2.0 | 95 | 84 | 0.30 | 0.25 |
| 13 | a-1 | (b-4) + (d-1) | 2.0 | 95 | 82 | 0.80 | 0.25 |
| 14 | a-1 | (b-4) + (c-1) + (d-1) | 2.0 | 95 | 83 | 0.80 | 0.25 |
| 15 | a-1 | b-6 | 2.0 | 95 | 80 | 0.70 | 0.25 |
| 16 | a-1 | b-7 | 2.0 | 95 | 79 | 0.30 | 0.25 |
| 17 | a-1 | b-8 | 2.0 | 95 | 78 | 0.20 | 0.25 |
| 18 | a-5 | b-6 | 8.0 | 95 | 81 | 0.70 | 0.25 |
| 19 | a-6 | b-6 | 2.0 | 95 | 82 | 0.80 | 0.23 |

TABLE 3-continued

| | Carrier cores | Resin composition | Feed coating quantity (pbm) | Packing (vol. %) | Material temp. (° C.) | Db/Dc | True specific gravity ratio B/A (Resin composition/cores) |
|---|---|---|---|---|---|---|---|
| 20 | a-7 | b-6 | 2.0 | 95 | 78 | 0.90 | 0.48 |
| 21 | a-8 | b-6 | 2.0 | 95 | 79 | 0.80 | 0.33 |
| 22 | a-1 | b-4 | 2.0 | 98 | 89 | 0.80 | 0.25 |
| | | | Comparative Example: | | | | |
| 1 | a-1 | b-4 | 2.0 | 30 | 105 | 0.80 | 0.25 |
| 2 | a-1 | b-4 | 2.0 | 10 | 70 | 0.80 | 0.25 |
| 3 | a-1 | Toluene solution of b-4 | 2.0 | — | 60 | — | 0.25 |
| 4 | a-1 | b-4 | 2.0 | 40 | 74 | 0.80 | 0.25 |
| 5 | a-1 | b-4 | 2.0 | 95 | 125 | 0.80 | 0.25 |
| 6 | a-1 | b-4 | 2.0 | 99 | 93 | 0.80 | 0.25 |

TABLE 4

| | Volume-base 50% particle diameter (μm) | True specific gravity (g/cm$^3$) | Degree of coalescence | Effective coat level (%) | Specific resistance (Ω · cm) |
|---|---|---|---|---|---|
| | | | Example: | | |
| 1 | 40 | 4.5 | B | 93 | $1.2 \times 10^{12}$ |
| 2 | 40 | 4.5 | B | 94 | $2.1 \times 10^{12}$ |
| 3 | 40 | 4.5 | A | 96 | $5.6 \times 10^{12}$ |
| 4 | 40 | 4.6 | A | 92 | $7.3 \times 10^{11}$ |
| 5 | 40 | 4.6 | B | 85 | $3.3 \times 10^{10}$ |
| 6 | 40 | 4.6 | A | 93 | $1.8 \times 10^{12}$ |
| 7 | 40 | 4.6 | B | 86 | $4.8 \times 10^{10}$ |
| 8 | 40 | 4.5 | A | 98 | $8.6 \times 10^{12}$ |
| 9 | 40 | 4.6 | C | 81 | $9.7 \times 10^{8}$ |
| 10 | 15 | 4.6 | B | 89 | $5.9 \times 10^{11}$ |
| 11 | 80 | 4.5 | B | 95 | $3.4 \times 10^{12}$ |
| 12 | 100 | 4.6 | B | 88 | $2.9 \times 10^{10}$ |
| 13 | 40 | 4.5 | A | 97 | $7.7 \times 10^{12}$ |
| 14 | 40 | 4.5 | A | 97 | $8.8 \times 10^{9}$ |
| 15 | 40 | 4.5 | A | 98 | $1.1 \times 10^{10}$ |
| 16 | 40 | 4.5 | A | 97 | $9.3 \times 10^{9}$ |
| 17 | 40 | 4.5 | A | 98 | $2.6 \times 10^{10}$ |
| 18 | 41 | 4.0 | A | 96 | $6.6 \times 10^{13}$ |
| 19 | 35 | 5.2 | A | 97 | $7.2 \times 10^{7}$ |
| 20 | 32 | 2.5 | A | 96 | $4.2 \times 10^{15}$ |
| 21 | 36 | 3.5 | A | 98 | $5.5 \times 10^{15}$ |
| 22 | 40 | 4.5 | B | 89 | $1.2 \times 10^{12}$ |
| | | | Comparative Example: | | |
| 1 | 40 | 4.6 | D | 61 | $6.3 \times 10^{7}$ |
| 2 | 40 | 4.6 | C | 69 | $1.6 \times 10^{8}$ |
| 3 | 40 | 4.7 | E | 53 | $2.3 \times 10^{7}$ |
| 4 | 40 | 4.6 | C | 75 | $4.5 \times 10^{8}$ |
| 5 | 40 | 4.6 | C | 79 | $9.3 \times 10^{9}$ |
| 6 | 40 | 4.5 | C | 78 | $7.6 \times 10^{9}$ |

TABLE 5

| | Image density | Q/M on photo-sensitive member (mC/kg) | Anti-leaking | ΔQ/M after leaving |
|---|---|---|---|---|
| Example: | | | | |
| 1 | 1.57 | 24.5 | B | B |
| 2 | 1.58 | 24.8 | B | B |
| 3 | 1.60 | 25.6 | A | B |
| 4 | 1.59 | 25.3 | A | B |
| 5 | 1.57 | 23.5 | B | B |
| 6 | 1.58 | 25.1 | A | B |
| 7 | 1.57 | 23.2 | B | C |
| 8 | 1.62 | 26.1 | A | B |
| 9 | 1.54 | 22.7 | C | C |
| 10 | 1.56 | 23.4 | B | B |

TABLE 5-continued

| | Image density | Q/M on photo-sensitive member (mC/kg) | Anti-leaking | ΔQ/M after leaving |
|---|---|---|---|---|
| 11 | 1.57 | 23.6 | B | B |
| 12 | 1.55 | 22.8 | B | C |
| 13 | 1.62 | 28.7 | A | A |
| 14 | 1.62 | 31.2 | A | A |
| 15 | 1.62 | 31.5 | A | A |
| 16 | 1.61 | 31.3 | A | A |
| 17 | 1.62 | 31.6 | A | A |
| 18 | 1.63 | 33.5 | A | A |
| 19 | 1.57 | 27.6 | B | B |
| 20 | 1.58 | 29.2 | B | B |
| 21 | 1.62 | 32.4 | A | A |
| 22 | 1.56 | 23.6 | B | B |
| Comparative Example: | | | | |
| 1 | 1.33 | 18.6 | D | E |
| 2 | 1.38 | 18.3 | D | D |
| 3 | 1.26 | 15.9 | E | E |
| 4 | 1.49 | 20.7 | C | D |
| 5 | 1.48 | 20.1 | C | D |
| 6 | 1.47 | 21.2 | C | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-328708, filed Dec. 20, 2007, which is hereby incorporated by reference herein in its entirety.

The invention claimed is:

1. A method for producing an electrophotographic carrier the carrier cores of which are coat-treated with at least a resin composition; the production method being a method of coat-treating electrophotographic carrier core surfaces with the resin composition, using an apparatus which has a rotator having a plurality of agitating blades on its surface and a casing provided leaving a gap between its inner wall and each agitating blade, and while mixing a coating treatment material constituted of the electrophotographic carrier cores and the resin composition, by rotating the rotator, where;

the coating treatment material that is introduced to a space defined between the rotator and the casing is in a packing of from 50% by volume or more to 98% by volume or less;

at the time of coating treatment, the electrophotographic carrier cores and the resin composition are put forward in one direction in the axial direction of the rotator by means of some agitating blade(s) of the plurality of agitating blades and are put backward in opposite direction in the axial direction of the rotator by means of at least some of the other agitating blades of the plurality of agitating blades, and the electrophotographic carrier core surfaces are coat-treated with the resin composition while being put forward and put backward; and the electrophotographic carrier cores and the resin composition are, at the time of coating treatment, temperature-controlled at temperature T (° C.) within the range that satisfies the following expression (1):

$$T \leqq Tg+20 \quad (1)$$

where Tg is glass transition temperature (° C.) of a resin component contained in the resin composition.

2. The method for producing an electrophotographic carrier according to claim 1, wherein the resin composition is fed into the apparatus in the form of a powder, and, where the volume-base 50% particle diameter (D50) of the resin composition standing before it is put into coating treatment is represented by Db (μm) and the volume-base 50% particle diameter (D50) of the electrophotographic carrier cores is represented by Dc (μm), the value of Db/Dc satisfies the following expression (2):

$$0.10 \leqq Db/Dc \leqq 50 \quad (2).$$

3. The method for producing an electrophotographic carrier according to claim 1, wherein the resin composition has at least a resin component and fine particles having a number average particle diameter (D1) of from 0.01 μm or more to 3.00 μm or less.

* * * * *